US011008713B2

(12) United States Patent
Swanson et al.

(10) Patent No.: US 11,008,713 B2
(45) Date of Patent: May 18, 2021

(54) ROTARY DRYER HAVING NOTCHED FLIGHTS

(71) Applicant: Astee, Inc., Chattanooga, TN (US)

(72) Inventors: Malcolm Leland Swanson, Chickamauga, GA (US); Andrew Muirhead Hobbs, Sheffield (GB)

(73) Assignee: Astec, Inc., Chattanooga, TN (US)

( * ) Notice: Subject to any disclaimer, the term of this patent is extended or adjusted under 35 U.S.C. 154(b) by 0 days.

(21) Appl. No.: 16/732,522

(22) Filed: Jan. 2, 2020

(65) Prior Publication Data

US 2021/0115629 A1 Apr. 22, 2021

Related U.S. Application Data

(60) Provisional application No. 62/924,220, filed on Oct. 22, 2019.

(51) Int. Cl.
*E01C 19/05* (2006.01)
*F26B 11/04* (2006.01)

(52) U.S. Cl.
CPC ..... *E01C 19/05* (2013.01); *F26B 11/0477* (2013.01)

(58) Field of Classification Search
CPC ... E01C 19/05; F26B 11/0409; F26B 11/0477
See application file for complete search history.

(56) References Cited

U.S. PATENT DOCUMENTS 3,407,511 A 10/1968 Camm
3,910,756 A * 10/1975 Henning ..... C08F 220/38 432/118
4,094,628 A * 6/1978 Rasmussen ..... F27B 7/20 432/80
4,172,701 A 10/1979 Bernt
4,558,525 A * 12/1985 Duske ..... F26B 11/0413 34/128
5,083,382 A 1/1992 Brashears
5,302,118 A 4/1994 Renegar et al.
5,378,083 A * 1/1995 Swanson ..... B09C 1/06 110/346
5,515,620 A 5/1996 Butler
5,746,006 A * 5/1998 Duske ..... F26B 11/0477 34/136
9,835,374 B2 * 12/2017 Swanson ..... F26B 21/08

OTHER PUBLICATIONS

International Search Report of counterpart PCT Application No. PCT/US2020/012017, filed Jan. 2, 2020.

* cited by examiner

*Primary Examiner* — Steven S Anderson, II
(74) *Attorney, Agent, or Firm* — Chambliss, Bahner & Stophel, P.C.; Stephen D. Adams

(57) ABSTRACT

A dryer adapted for use in an asphalt plant. The dryer includes a drum having an inner wall and a flight having a proximal end connecting the flight to the inner wall of the drum and a distal end that is spaced apart from the proximal end. A first profile extends from the proximal end to the distal end of the flight and defines a flight shape. A notch is formed in the distal end of the flight, which notch includes a notch shape that is defined by a second profile. The second profile has a length L, a center point, and a portion that substantially approximates a conic section.

11 Claims, 7 Drawing Sheets

ROTARY DRYER HAVING NOTCHED FLIGHTS

CROSS-REFERENCE TO RELATED APPLICATION

This application claims the benefit of U.S. Provisional Patent Application No. 62/924,220, filed on Oct. 22, 2019 and entitled ROTARY DRYER HAVING NOTCHED FLIGHTS, which is incorporated herein by reference in its entirety.

TECHNICAL FIELD

The present invention relates generally to rotary dryer systems. More particularly, the present invention relates to a rotary dryer for use in an asphalt plant said dryer having flights with a conic section-shaped notch.

BACKGROUND OF THE INVENTION

With initial reference to FIGS. 1 and 2, a conventional rotary dryer used in an asphalt plant generally comprises an inclined elongate cylinder or drum 10 through which is forced a draft of heated air and/or combustion gases from a burner. The material 12 to be dried (i.e., aggregate material) is introduced at an inlet end of the rotating drum 10 and is then carried through the drum in contact with the heated air draft. The interior of the dryer is provided with flights 14, which are fin-like structures that are peripherally mounted to an inner wall 16 of the drum. These flights 14 circulate the aggregate material 12 and increase the amount of time that the aggregate material remains exposed to the heated air and/or combustion gases inside the drum 10, which improves the efficiency of the dryer by increasing the heat transfer between the heated air and the aggregate material.

As the drum 10 rotates in direction "D" (shown in FIG. 2), the flights 14 scoop and carry portions of the aggregate material 12 upwards around the periphery of the drum. Aggregate material 10 then falls or "showers" from the flights downwards through the drum and the heated air draft. This showering creates a curtain or veil 18 of aggregate material 10 anywhere across the width of the dryer, including from the uphill side 20 of the drum 10 (i.e., the side where the flights are traveling upwardly within the drum as the drum rotates) to the downhill side 22 of the drum (i.e., the side where the flights are traveling downwardly within the drum as the drum rotates).

Showering of aggregate material is critical to maximizing the efficiency of heat transfer from the heated air draft to the aggregate material for drying that aggregate material effectively. The density or thickness of the veil of aggregate material may vary across the width of the drum based on a number of factors, including the type and particle size of aggregate material being processed, the volume of aggregate material within the drum, and the speed of rotation of the drum, etc. Ideally, the curtain will span the width of the interior of the drum, including particularly the center of the drum, where the highest energy content of the heated air is typically located.

Attempts have been made to improve the distribution of aggregate material within the drum by modifying the number and arrangement of flights within the drum. Additionally, certain design changes have been made to the shape of the individual flights themselves in order to vary their performance. For example, with reference to FIGS. 3-5 and U.S. Pat. No. 9,835,374, flight 24 is provided with a V-shaped notch 26 that is formed by a pair of intersecting straight lines 28 formed in the flight that intersect at a sharp point 30. The purpose of this V-shaped notch 26 was to increase the distribution of aggregate material across the width of the drum. However, through experimentation, it was found that under certain circumstances the V-shaped notch 26 resulted in a relatively thin veil of aggregate material on the uphill side of the drum and a comparatively thicker veil of aggregate material on downhill side of the drum. Additionally, it has been found that abrupt changes in the overall shape profile of the flight 24, such as those between straight sections 32 (shown in FIG. 5) can lead to uneven showering of aggregate material across the width of the drum.

What is needed, therefore, is a rotary dryer design having flights that produce a consistent and well-distributed veil of aggregate material throughout the drum for a range of operating conditions, including for various aggregate material mixes, processing volumes, and processing rates.

Notes on Construction

The use of the terms "a", "an", "the" and similar terms in the context of describing the invention are to be construed to cover both the singular and the plural, unless otherwise indicated herein or clearly contradicted by context. The terms "comprising", "having", "including" and "containing" are to be construed as open-ended terms (i.e., meaning "including, but not limited to,") unless otherwise noted. The terms "substantially", "generally" and other words of degree are relative modifiers intended to indicate permissible variation from the characteristic so modified. The use of such terms in describing a physical or functional characteristic of the invention is not intended to limit such characteristic to the absolute value which the term modifies, but rather to provide an approximation of the value of such physical or functional characteristic.

Terms concerning attachments, coupling and the like, such as "connected" and "interconnected", refer to a relationship wherein structures are secured or attached to one another either directly or indirectly through intervening structures, as well as both moveable and rigid attachments or relationships, unless specified herein or clearly indicated by context. The term "operatively connected" is such an attachment, coupling or connection that allows the pertinent structures to operate as intended by virtue of that relationship.

The use of any and all examples or exemplary language (e.g., "such as" and "preferably") herein is intended merely to better illuminate the invention and the preferred embodiment thereof, and not to place a limitation on the scope of the invention. Nothing in the specification should be construed as indicating any element as essential to the practice of the invention unless so stated with specificity.

BRIEF SUMMARY OF THE INVENTION

The above and other needs are met by a dryer adapted for use in an asphalt plant. The dryer includes a drum having an inner wall and a flight having a proximal end connecting the flight to the inner wall of the drum and a distal end that is spaced apart from the proximal end. A first profile extends from the proximal end to the distal end of the flight and defines a flight shape. A notch is formed in the distal end of the flight, which notch includes a notch shape that is defined by a second profile. The second profile has a length L, a center point, and a portion that substantially approximates a conic section. In certain embodiments of the invention, the conic section portion of the second profile is disposed at approximately the center point of the second profile. In some embodiments, at least a portion of the first profile substantially also approximates a conic section. In certain preferred embodiments, the dryer includes a plurality of substantially identical flights connected to the inner wall of the drum and arranged with their proximal ends substantially parallel to each other.

The flight has a flight depth D1, measured along a surface of the flight between the proximal end and the distal end and the notch has a notch depth D2 that is measured along the surface of the flight from the distal end. In certain embodiments, notch depth D2 is approximately 20% to approximately 80% of the flight depth D1. In alternative embodiments, notch depth D2 is approximately 30% to approximately 60% of the flight depth D1. In other embodiments, notch depth D2 is approximately 50% of the flight depth D1. In some embodiments, notch depth D2 varies along the length L of the second profile and is greatest at the center point of the second profile. In some embodiments, at least a portion of the first profile is curved.

In other embodiments, the dryer includes a drum having an inner wall and a flight having a proximal end connecting the flight to the inner wall of the drum and a distal end that is spaced apart from the proximal end. A first profile extends from the proximal end to the distal end and defines a flight shape of the flight that includes a portion that substantially approximates a conic section. A notch is formed in the distal end of the flight having a notch shape that is defined by a second profile, the second profile having a length with a center point. In certain embodiments, the first profile is defined by a spline comprising two or more sections, including at least one curved section, wherein each section has two ends and a shape that is defined by a polynomial function, said sections being joined together at adjacent ends. In some embodiments, at least a portion of the first profile substantially approximates a conic section.

The present invention also provides a method for optimizing dryer performance. In a first step of the method, a design for a dryer that is adapted for use in an asphalt plant is provided. The dryer includes a drum having an inner wall and a flight having a proximal end connecting the flight to the inner wall of the drum and a distal end that is spaced apart from the proximal end. A first profile extends from the proximal end to the distal end and defines a shape of the flight. A notch is formed in the distal end of the flight. The notch has a notch shape that is defined by a second profile, the second profile having a length with a center point. A conic section-shaped portion is provided in at least one of the first profile or the second profile of the flight. The conic section-shaped portion is modeled by an intersection of a cone with a plane intersecting the cone.

Next, the method includes the step of adjusting at least one of the first profile and the second profile to optimize performance of the flight. In certain embodiments, the adjustment step includes adjusting the shape of the substantially conic section-shaped section by modifying an angle of intersection $\alpha$ measured between a flat bottom of the cone and the plane intersecting the cone. In certain embodiments of the method, the dryer also includes a flight depth D1, measured along a surface of the flight between the proximal end and the distal end and a notch formed in the distal end of the flight, with the notch having a notch depth D2 that is measured along a surface of the flight. In those cases, the adjustment step may include adjusting the second profile to modify the notch depth as a percentage of the flight depth. For example, in certain cases, the notch depth is modified such that it is approximately 20% to approximately 80% of the flight depth.

In another embodiment of the invention, a dryer apparatus is provided that includes a substantially curved flight configured for use in a dryer in an asphalt plant. Also provided is a notch formed in the flight that has a notch center and that is defined by a continuous curve. In some embodiments, the continuous curve includes a conic section located approximately at the notch center. In certain embodiments, the curved flight has a flight depth and the notch has a notch depth that is 20-80% of the flight depth.

In order to facilitate an understanding of the invention, the preferred embodiments of the invention, as well as the best mode known by the inventor for carrying out the invention, are illustrated in the drawings, and a detailed description thereof follows. It is not intended, however, that the invention be limited to the particular embodiments described or to use in connection with the apparatus illustrated herein. Therefore, the scope of the invention contemplated by the inventor includes all equivalents of the subject matter described herein, as well as various modifications and alternative embodiments such as would ordinarily occur to one skilled in the art to which the invention relates. The inventor expects skilled artisans to employ such variations as seem to them appropriate, including the practice of the invention otherwise than as specifically described herein. In addition, any combination of the elements and components of the invention described herein in any possible variation is encompassed by the invention, unless otherwise indicated herein or clearly excluded by context.

BRIEF DESCRIPTION OF THE DRAWINGS

The presently preferred embodiments of the invention are illustrated in the accompanying drawings, in which like reference numerals represent like parts throughout, and in which.

DETAILED DESCRIPTION OF THE INVENTION

This description of the preferred embodiments of the invention is intended to be read in connection with the accompanying drawings, which are to be considered part of the entire written description of this invention. The drawings are not necessarily to scale, and certain features of the invention may be shown exaggerated in scale or in somewhat schematic form in the interest of clarity and conciseness.

Figure 7:
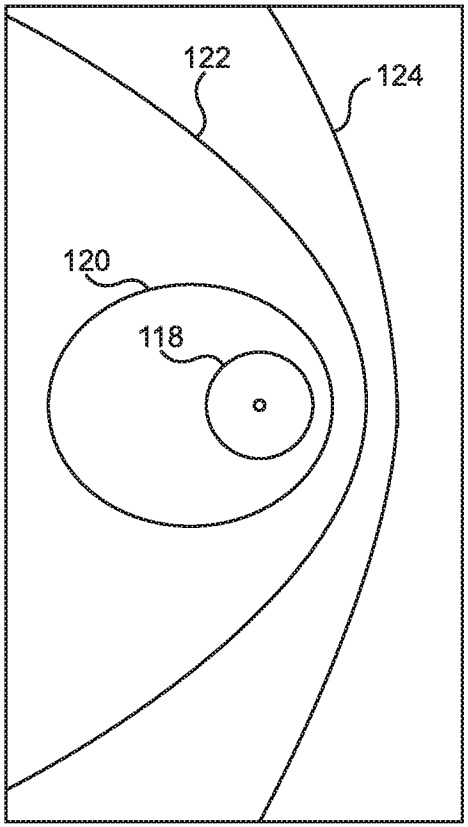
FIG. 7 depicts the conic sections of FIG. 6 from an overhead perspective along the Y-axis.
Figure 6:
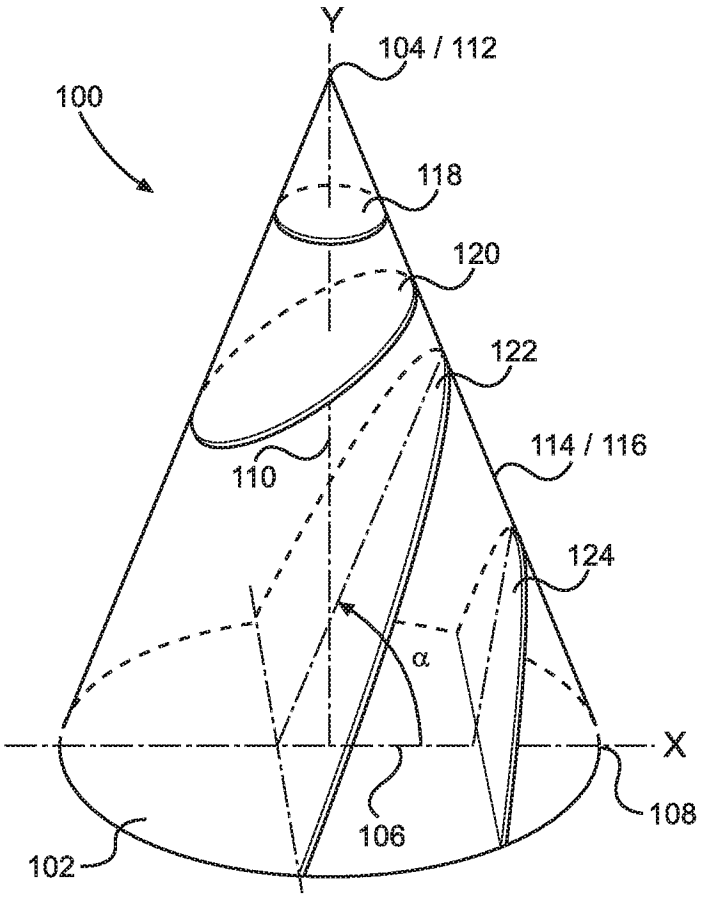
FIG. 6 depicts a cone and conic sections that are created by intersecting the cone with a plane.
Figure 8:
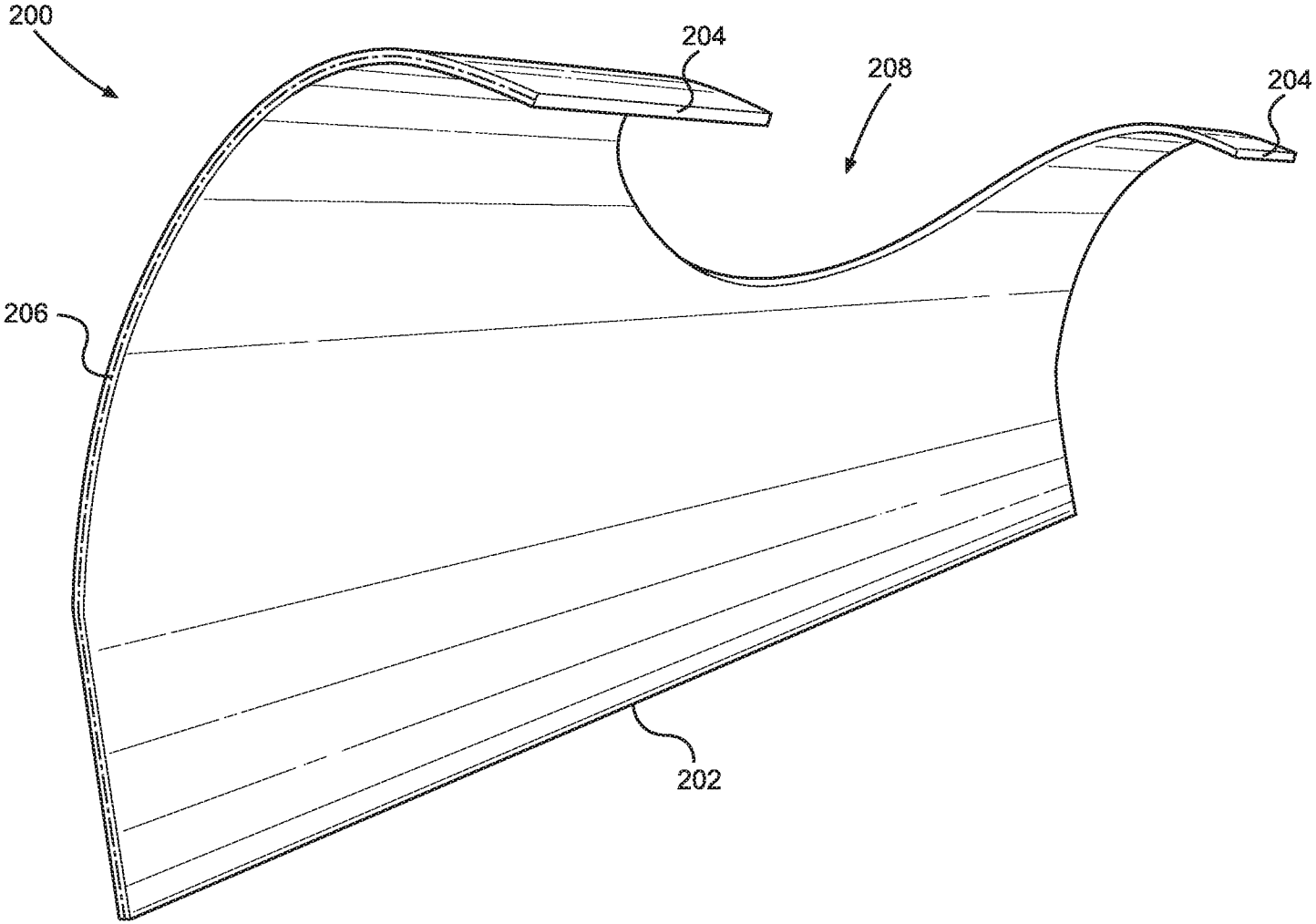
FIG. 8 is a perspective view of a flight having an overall parabolic shape and a parabolic-shaped notch formed therein according to an embodiment of the present invention.
Figure 10:
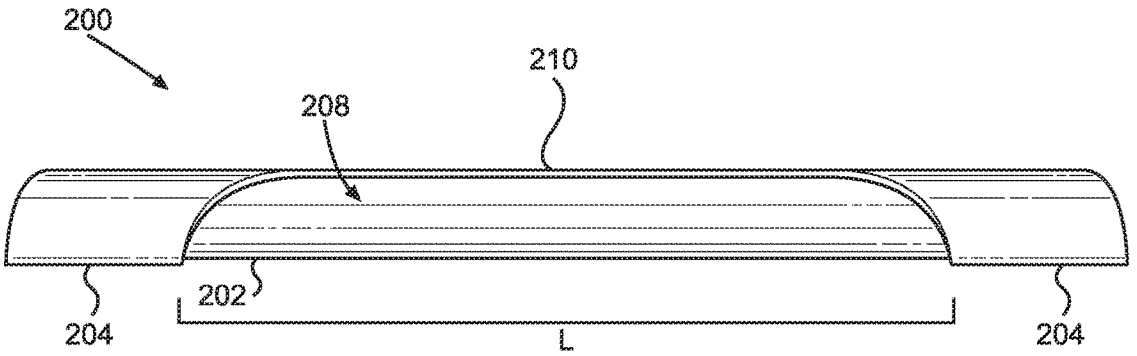
FIG. 10 is a top plan view of the flight of FIG. 9.
Figure 9:
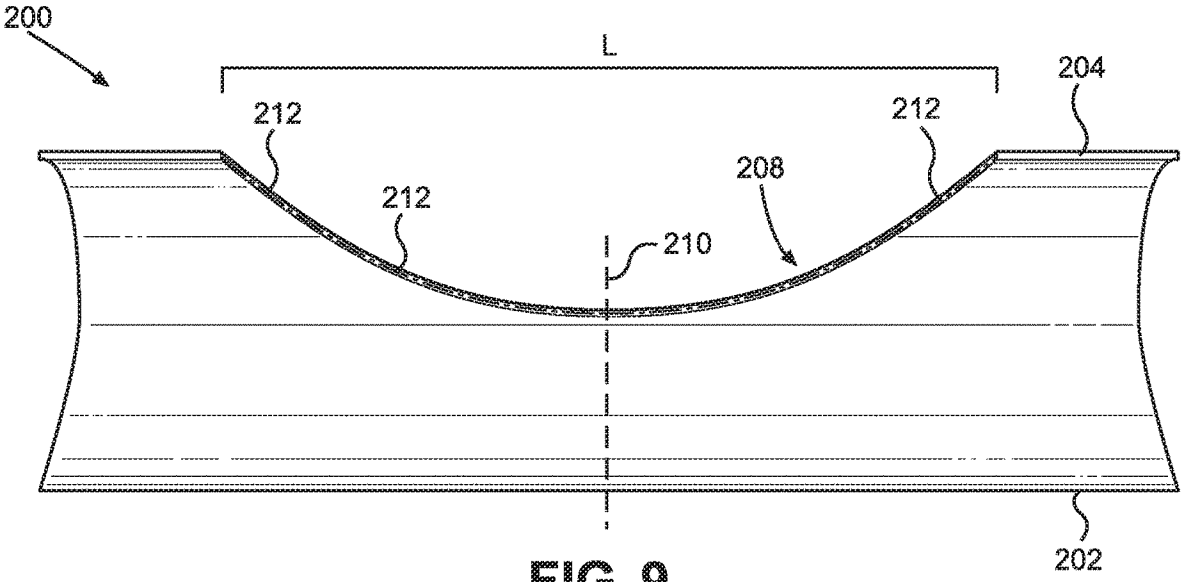
FIG. 9 is a front elevation view of the flight of FIG. 9.
Figure 11:
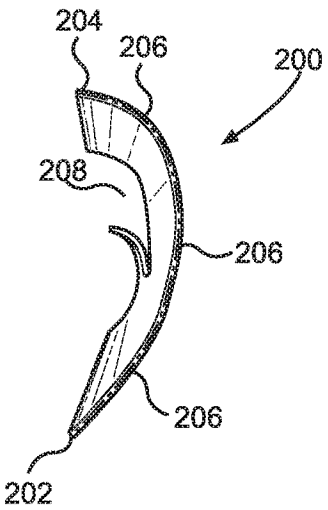
FIG. 11 is a right-side elevation view of the flight of FIG. 9.

With reference now to FIGS. 6 and 7, a cone 100 is illustrated. This particular cone 100 is a single three-dimensional geometric shape (i.e., not a double cone) that tapers upwards from a flat base 102 (i.e., not an infinitely extended cone) to an apex 104. In general, a cone may be constructed by revolving a triangle about an axis extending through one of its sides. In this particular case, the cone 100 is formed by a right triangle having an x-leg 106 extending along a horizontal x-axis and ending at a point 108, a y-leg 110 extending along a vertical y-axis that is perpendicular to the x-axis and ending at a point 112, and a hypotenuse 114 extending between point 108 and point 112. Revolving that triangle about the y-axis forms cone 100, including the flat base 102, the apex 104, and the wall 116 extending between the base and the apex. Various conic sections may formed by intersecting a cone with a planar surface. The shape that is formed depends on the angle of intersection. In the illustrated embodiment, that angle of intersection $\alpha$ is measured from the flat bottom 104 of the cone 100 to the plane intersecting the cone. When angle $\alpha$ is 0°, a circular shape 118 is formed. As angle $\alpha$ increases, other conic sections are formed, including an ellipse 120, a parabola 122, and a hyperbola 124. Eventually, if angle $\alpha$ were increased to 90°, a "V" or triangle shape is formed.

Figure 1:
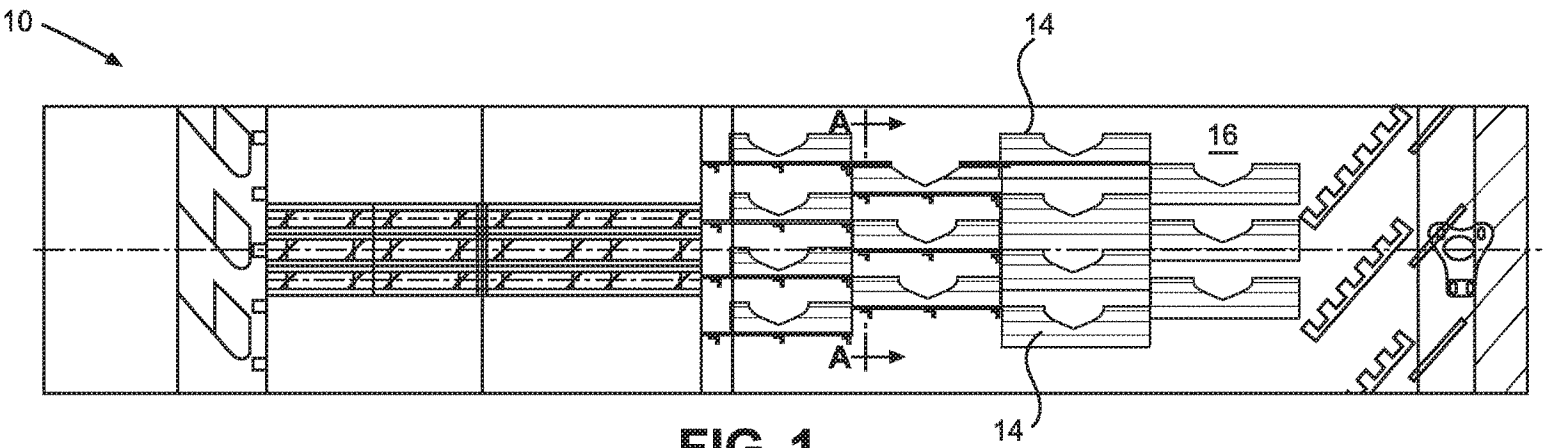
FIG. 1 Prior Art
FIG. 1 is a partial sectional front view depicting a conventional dryer drum.
Figure 2:
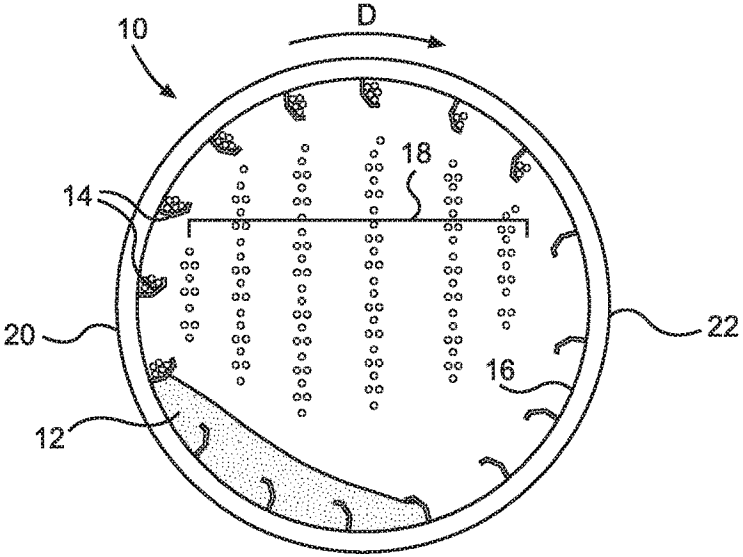
FIG. 2 Prior Art
FIG. 2 is a cross-sectional view of a conventional dryer drum equipped with flights.
Figure 5:
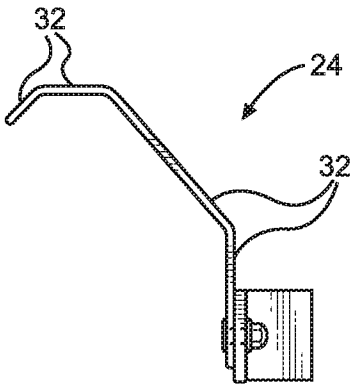
FIG. 5 Prior Art
FIG. 5 is a right-side elevation view of the flight of FIG. 3.
Figure 4:
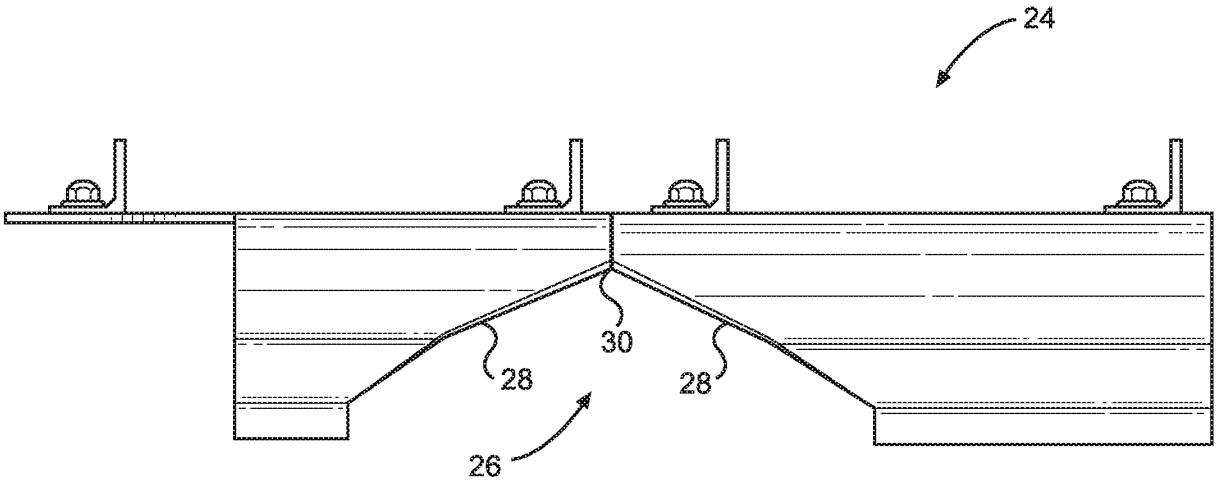
FIG. 4 Prior Art
FIG. 4 is a top plan view of the flight of FIG. 3.
Figure 3:
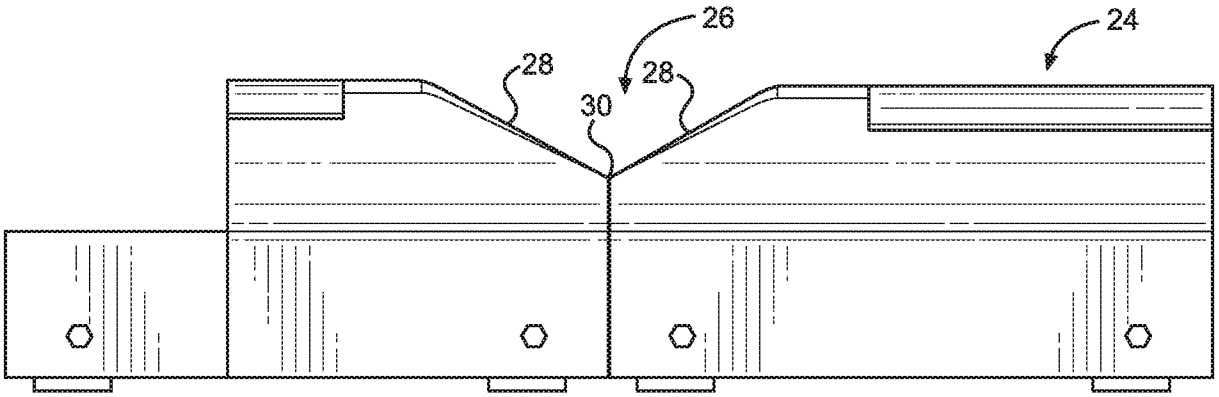
FIG. 3 Prior Art
FIG. 3 is a front elevation view of a conventional flight.

With reference now to FIGS. 8-11, there is provided a flight 200 suited for use in a dryer used in an asphalt plant according to an embodiment of the present invention. Preferably, when in use, a plurality of substantially identical flights 200 would be connected to an inner wall 16 (FIG. 2) of a drum 10 and arranged substantially parallel to each other. Although, in other embodiments, other arrangements other than a substantially parallel arrangement may be used.

Flight 200 has a proximal end 202 that connects the flight to an inner wall of the drum of a rotary dryer and a distal end 204 that is spaced apart from the proximal end. A first profile 206 extends through the flight 200, from the proximal end 202 to the distal end 204, and defines the shape or profile of the flight (when viewed from one side, as in FIG. 11). In certain embodiments, the first profile 206 includes a portion that substantially approximates a portion of a conic section. The term "substantially approximates", when used to describe a conic section, or a portion of a conic section, indicates a spline that approximates a conic section or a portion thereof, as well as a continuous curve comprising a conic section or a portion thereof.

In the illustrated embodiment, first profile 206 includes at least one curved portion and comprises a partial substantially parabolic overall shape (when viewed from one side, as in FIG. 11) of the flight 200. In some cases, the first profile 206 may comprise a single, continuously curved line. However, in this particular case, first profile 206 is a spline that is comprised of two or more line sections, including at least one curved section, that are joined together at ends. The shape of these sections may be defined by polynomial functions, including first-degree polynomials (i.e., straight lines) and second-degree polynomials (i.e., curved lines). In this particular case, first profile 206 includes several straight or curved sections of varying lengths between the proximal end 202 and the distal end 204 to define the substantially parabolic shape.

A notch 208 is formed in the flight 200 and has a length L with a center point 210. The shape of the notch 208 is defined by a second profile 212 that extends through the flight along the length L of the notch. In certain preferred embodiments, a portion of the second profile 212 at least substantially approximates a conic section or a portion thereof. The conic section of the second profile 212 may be located at any position along the length L of the notch 208. In a preferred embodiment, the conic section of the second profile 212 is disposed at approximately the center point 210 of the notch 208. However, as discussed above, a V-shaped notch tends to produce a relatively thin veil of aggregate material on the uphill side of the drum and a comparatively thicker veil of aggregate material on downhill side of the drum. For that reason, as the term is used herein, "conic section" specifically excludes the V-shape formed when angle of intersection $\alpha$ (FIG. 6) is equal to 90°. Therefore, "conic section" refers only to those shapes (or portions thereof) formed when angle of intersection $\alpha$ is less than 90°, including a portion of a circle, ellipse, parabola or hyperbola.

Figure 12:
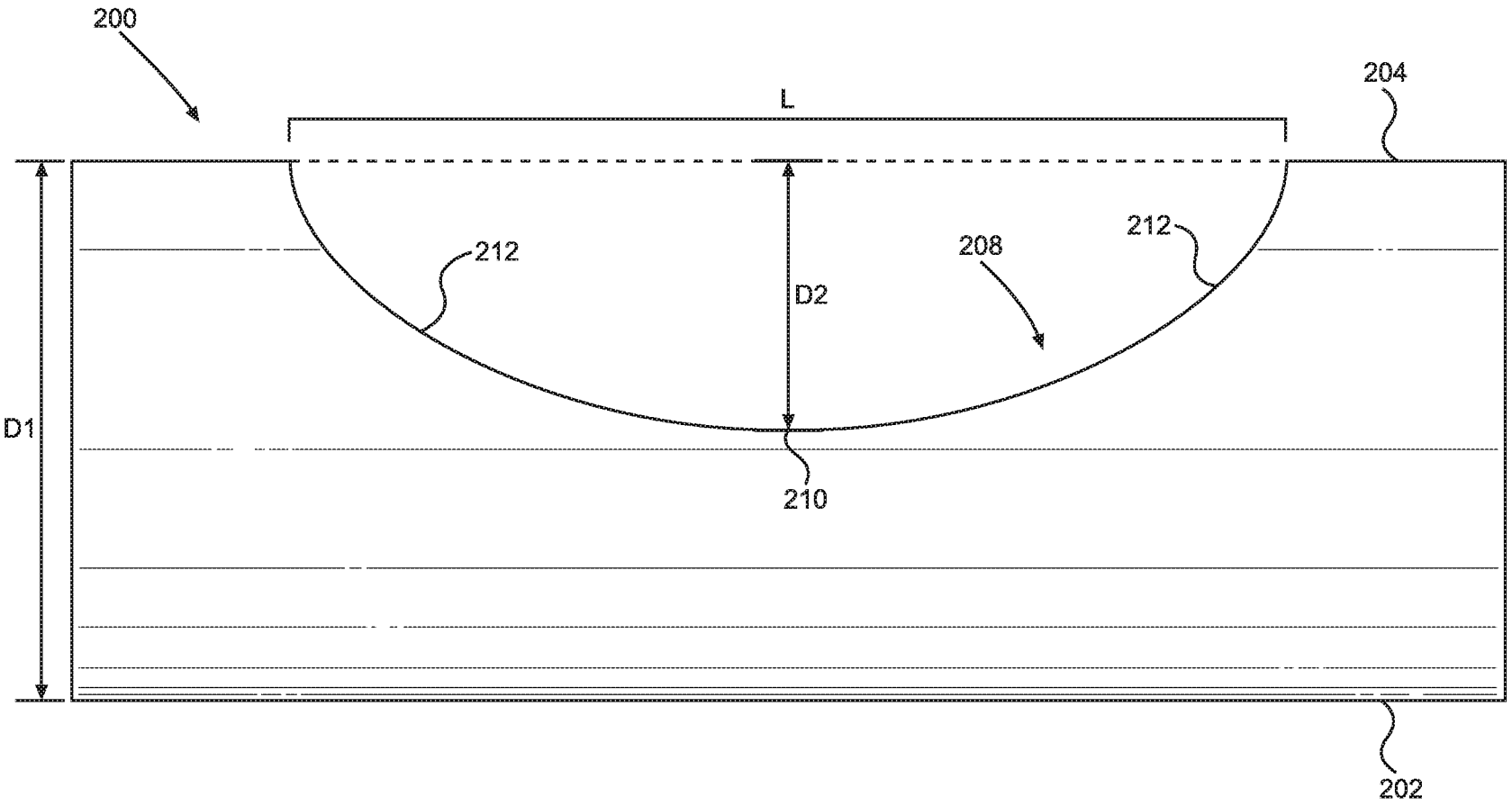
FIG. 12 is a front elevation view of the flight of FIG. 9 shown in a flattened condition illustrating the parabolic-shaped notch.

Referring now to FIG. 12, flight 200 has a flight depth D1, measured along a surface of the flight, between the proximal end 202 and the distal end 204. Additionally, flight 200 has a notch depth D2 that is measured along the surface of the flight from the distal end 204. In the preferred embodiment illustrated in the drawings, notch depth D2 varies along the length L of the second profile 212. In some embodiments, notch depth D2 is greatest at a center point of the second profile. In certain cases, the maximum notch depth D2 is approximately 20% to approximately 80% of the flight depth D1. In other cases, the maximum notch depth D2 is approximately 30% to approximately 60% of the flight depth. In still further cases, the maximum notch depth D2 is approximately 50% of the flight depth D1.

Figure 13:
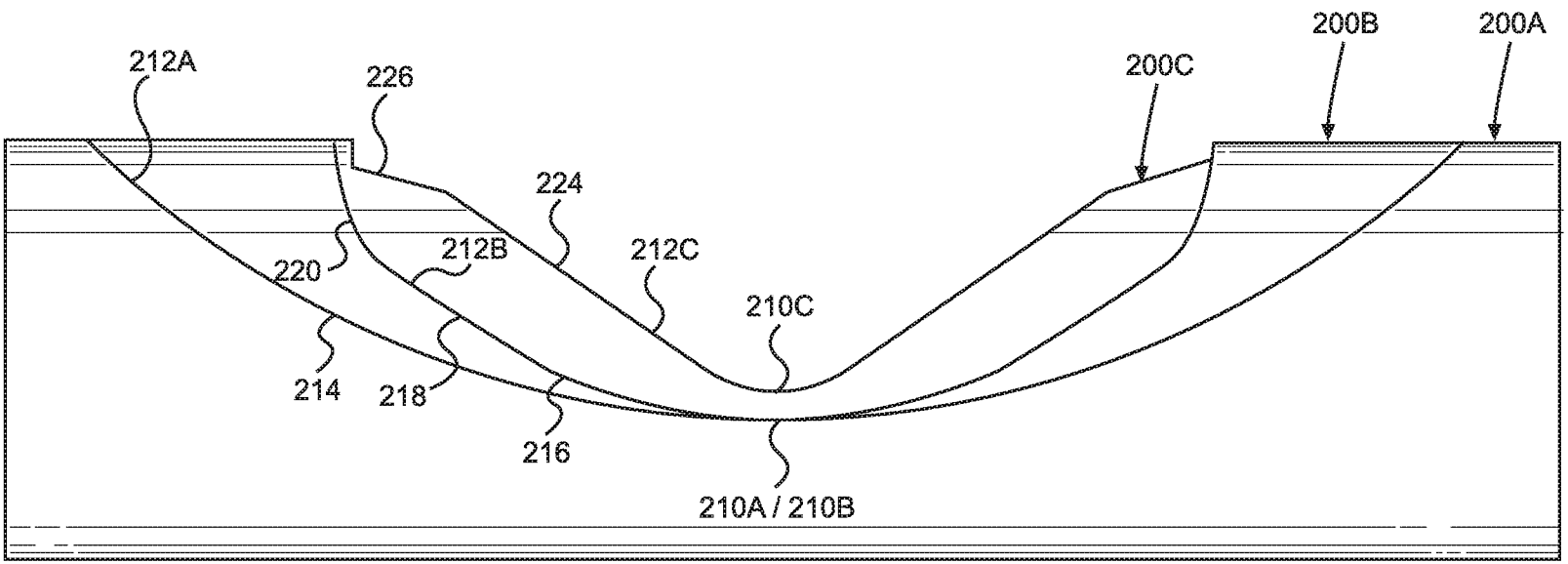
FIG. 13 is a front elevation view depicting notch profiles that incorporate portions of a conic section shape according to three alternative embodiments of the present invention.

With reference to FIG. 13, a portion of three flights 200A, 200B, 200C with alternative notch designs, determined by second profiles 212A, 212B, 212C, is illustrated. As detailed below, second profiles, like first profiles, may be splines. Second profile 212A includes a conic section portion 214 centered approximately at center point 210 that is hyperbolic in shape, which indicates a steep angle $\alpha$. Second profile 212B includes a conic section portion 216 that is centered approximately at center point 210B. Conic section portion 216 is more parabolic in shape than the conic section portion of second profile 212A, which indicates a more moderate angle $\alpha$. Second profile 212B also includes a straight portion 218 that is adjacent conic section portion 216 and another hyperbolic conic section portion 220 located adjacent the straight portion. Lastly, second profile 212C includes a conic section portion 222 that is centered approximately at center point 210C, which indicates an even more moderate angle $\alpha$. Conic section portion 222 is more circular than either of the conic section portions of second profile 212A or second profile 212B. A pair of adjacent straight sections 224, 226 are located adjacent conic section portion 222 to define second profile 212C. From the above discussion, it may be appreciated that by designing second profiles as splines, the resulting notches for flights may be highly customizable to meet process requirements and to optimize performance of the dryer.

Although this description contains many specifics, these should not be construed as limiting the scope of the invention but as merely providing illustrations of some of the presently preferred embodiments thereof, as well as the best mode contemplated by the inventor of carrying out the invention. The invention, as described and claimed herein, is susceptible to various modifications and adaptations as would be appreciated by those having ordinary skill in the art to which the invention relates.

What is claimed is:

1. A dryer adapted for use in an asphalt plant, the dryer comprising:

a drum having an inner wall;

a flight having a proximal end connecting the flight to the inner wall of the drum and a distal end that is spaced apart from the proximal end;

a first profile extending from the proximal end to the distal end that defines a flight shape of the flight;

a notch formed in the distal end of the flight having a notch shape that approximates a conic section and that is defined by a second profile, the second profile having a length L, a notch center, and formed by a pair of notch profile portions with ends joined together at the notch center and opposite ends joined to the distal end of the flight, each notch profile portion comprising a spline of at least two sections connected together at ends and that are each defined by a different polynomial function and have a different curvature.

2. The dryer of claim 1 wherein the first profile comprises a partial conic section formed by a spline of at least two sections connected together at end and including at least two sections that have a different curvature.

3. The dryer of claim 1 wherein at least a portion of the first profile is curved.

4. A dryer apparatus comprising:

a flight configured for use in a dryer in an asphalt plant and having a proximal end configured to mount to an inner surface of a drum of the dryer and a distal end, wherein a shape of the flight is continuous and curved; and a notch disposed in the distal end of the flight, the notch having a notch center and being defined by a continuous curve that approximates a conic section and that is formed by a pair of notch profile portions with ends joined together at the notch center and opposite ends joined to the distal end of the flight, each notch profile portion comprising a spline of at least two sections connected together at ends and that each have a different curvature.

5. The dryer of claim 1 wherein the at least two sections of each notch profile portion comprise a straight section and a curved section.

6. The dryer of claim 1 wherein each notch profile portion comprises a spline of at least three sections that are each defined by a different polynomial function to provide a different curvature.

7. The dryer of claim 1 wherein the spline of each notch profile portion includes two or more conic sections that are each selected from the group consisting of a hyperbola and a parabola.

8. The dryer of claim 7 wherein each notch profile portion further includes at least one straight section.

9. The dryer apparatus of claim 4 wherein the spline includes at least one curved section and one straight section.

10. The dryer apparatus of claim 4 wherein the spline is continuously curved without bends.

11. A dryer flight configured for placement within a drum of a dryer and configured to scoop, carrying, and shower asphalt material within the drum as the drum is rotated, the dryer flight comprising:

a proximal end configured to connect the flight to an inner wall of the drum;

a distal end that is spaced apart from the proximal end;

a flight shape beginning at the proximal end and ending at the distal end of the flight that is defined by a spline having three or more sections joined together at ends, wherein the three or more sections include at least two of the following types of sections that are each defined by a polynomial function: a straight section, a parabolic section, or a hyperbolic section, wherein the end of the section is located where the type of section changes from one type of section to another type of section or where the polynomial function and curvature of the section changes to a different polynomial function and different curvature;

a notch formed in the distal end of the flight having a notch shape defined by a pair of notch portions joined together at a notch center of the notch and extending to the distal end of the flight, a shape of each notch portion defined by a spline having three or more sections joined together at ends, wherein the three or more sections include at least two of the following types of sections that are each defined by a polynomial function: a straight section, a parabolic section, or a hyperbolic section, wherein the end of the section is located where the type of section changes from one type of section to another type of section or where the polynomial function and curvature of the section changes to a different polynomial function and curvature.

* * * * *